US007922484B2

(12) United States Patent
Tetsumoto et al.

(10) Patent No.: US 7,922,484 B2
(45) Date of Patent: Apr. 12, 2011

(54) ROTARY HEARTH FURNACE

(75) Inventors: Masahiko Tetsumoto, Kobe (JP); Sumito Hashimoto, Kobe (JP); Hiroshi Sugitatsu, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 510 days.

(21) Appl. No.: 12/067,422

(22) PCT Filed: Oct. 10, 2006

(86) PCT No.: PCT/JP2006/320176

§ 371 (c)(1),
(2), (4) Date: Mar. 19, 2008

(87) PCT Pub. No.: WO2007/043512

PCT Pub. Date: Apr. 19, 2007

(65) Prior Publication Data

US 2009/0136887 A1 May 28, 2009

(30) Foreign Application Priority Data

Oct. 11, 2005 (JP) ..... 2005-296746

(51) Int. Cl.
*F27B 9/30* (2006.01)
*F27B 9/34* (2006.01)

(52) U.S. Cl. ..... 432/138; 266/173

(58) Field of Classification Search ..... 432/138, 432/141, 195; 266/173, 176, 177; 414/160, 414/586, 587, 588
See application file for complete search history.

(56) References Cited

U.S. PATENT DOCUMENTS

| | | | | |
|---|---|---|---|---|
| 2,074,662 | A * | 3/1937 | McLay | 432/138 |
| 4,578,031 | A * | 3/1986 | Johnson et al. | 432/138 |
| 6,305,931 | B1 * | 10/2001 | De Marchi et al. | 432/138 |
| 6,685,466 | B2 * | 2/2004 | Harada et al. | 432/138 |
| 2010/0052226 | A1 * | 3/2010 | Rinker et al. | 266/173 |

FOREIGN PATENT DOCUMENTS

| | | |
|---|---|---|
| GB | 447 114 | 5/1936 |
| JP | 2001 181720 | 7/2001 |
| JP | 2001 324274 | 11/2001 |
| JP | 2002-310564 | 10/2002 |
| JP | 2002 310565 | 10/2002 |
| JP | 2004-3729 | 1/2004 |
| RU | 2217504 | 11/2003 |

* cited by examiner

*Primary Examiner* — Gregory A Wilson
(74) *Attorney, Agent, or Firm* — Oblon, Spivak, McClelland, Maier &Neustadt, L.L.P.

(57) ABSTRACT

To provide a rotary hearth furnace which has a simple furnace structure in which the furnace is not damaged even if the furnace is operated for a long term while presenting general equations capable of adequately determining a thermal expansion margin in the rotary hearth furnace.

4 Claims, 7 Drawing Sheets

Prior Art

Prior Art

Prior Art

ROTARY HEARTH FURNACE

TECHNICAL FIELD

The present invention relates to a rotary hearth furnace, and more particularly, relates to a rotary hearth furnace capable of preventing a furnace refractory from falling down by reducing effect due to thermal expansion of a furnace material.

BACKGROUND ART

A rotary hearth furnace includes an outer circumference wall, an inner circumference wall, and a rotary hearth which is arranged between the walls. The rotary hearth includes an annular hearth frame, a hearth heat insulating material which is arranged on the hearth frame, and a refractory which is arranged on the hearth heat insulating material.

Such a rotary hearth is rotated by a driving mechanism. With respect to the driving mechanism, for example, there are a gear mechanism in which a pinion gear driven by a rotary shaft provided to a lower part of the furnace engages with a rack rail which is circumferentially fixed to a bottom part of the hearth frame, and a mechanism in which a plurality of drive wheels provided to the bottom part of the hearth frame drive on a track which is circumferentially provided on a floor.

The rotary hearth furnace which has such a structure is used for metal heating process of a steel billet and the like or combustion process of flammable waste, for example. In recent years, methods of producing reduced iron from iron oxide by using the rotary hearth furnace have attracted notice.

Hereinafter, with reference to a schematic view illustrating a known rotary hearth furnace illustrated in FIG. 5, an example of reduced iron production process by the rotary hearth furnace will be described.

(1) Powdered iron oxide (iron ore, electric furnace dust, etc.) and powdered carbonaceous reducing agents (coal, cokes, etc.) are mixed and palletized to form green pellets.

(2) The green pellets are heated up to such a temperature area that combustible volatile components generated from the pellets may not ignite to remove contained moisture to obtain dry pellets (raw material 29).

(3) The dry pellets (raw material 29) are supplied into a rotary hearth furnace 26 using a suitable charging unit 23. Then, a pellet layer which has a thickness of about one to two pellets is formed on a rotary hearth 21.

(4) The pellet layer is radiant heated for reduction by combustion of a burner 27 installed to an upper part of the inside of the furnace to metalize.

(5) The metalized pellets are cooled by a cooler 28. The cooling is performed, for example, by directly spraying gas on the pellets or indirectly cooling by a cooling water jacket. By cooling the pellets, mechanical strength endurable for handling at a time of discharge and after the discharge is obtained. Then, the cooled pellets are discharged by a discharge unit 22.

(6) After the metalized pellets (reduced iron 30) are discharged, the dry pellets (raw material 29) are immediately charged and by repeating the above process, reduced iron is produced.

The rotary hearth furnace has a lower part heat insulation structure that is composed of an annular hearth frame, a heat insulation material layer which is arranged on the hearth frame, and a refractory layer which is arranged on the heat insulation material layer. To an outer circumference side and an inner circumference side of the rotary hearth, an outer circumference side corner refractory and an inner circumference side corner refractory are arranged through hearth curb castings respectively.

At a time of operation of the rotary hearth furnace, to an upper part of the lower part heat insulation structure which is surrounded by the outer circumference side and the inner circumference side corner refractories of the rotary hearth, surface materials such as a mixture of dolomite, iron ore, iron oxide (iron ore, electric furnace dust, etc.), carbonaceous reducing agents (coal, cokes, etc), or a material to be processed are charged and reduction process is performed.

Accordingly, due to the difference among these materials which constitute the rotary hearth, interference among the lower part heat insulation structure, the corner refractories, and the surface materials becomes complicated, and in some cases, the corner refractories or the lower part heat insulation structure may be damaged.

Especially, although there is no problem on the surface material during construction of the rotary hearth furnace before the rotary hearth furnace is operated, once the rotary hearth furnace is operated and continuously used for a long period, the dolomite and the iron ore accumulates, solidifies, and becomes unified. The unified dolomite and iron ore often circularly solidifies at a furnace outer circumference part and sometimes the solidified material is formed all over the furnace. If the rotary hearth furnace is cooled after the furnace surface is unified as described above, the refractories and the heat insulating materials are contracted and this causes gaps or cracks.

To the layer of the dolomite and the iron ore which is to be a surface layer, it is not possible to intentionally provide an expansion margin, and thus, cracks at points where the cracks most likely to occur and contracts by itself. If the surface layer is heated up again, the surface layer does not always return to the state before the cooling, there are many parts affected by external force due to thermal expansion. The external force due to the thermal expansion acts not only in a circumferential direction, but acts in a radius direction.

On the other hand, the hearth frame is structured to contract, however, when heated again, as a matter of course, because the hearth frame is heated up from an upper part, during nonsteady temperature increase to a steady state in the furnace temperature, a phenomenon that only members in the upper part expand occurs. By the phenomenon, the corner refractory provided at an end part of the inner circumference side or the outer circumference side of the rotary hearth is pushed, and may fall to the outside of the furnace, may be floated, or a fixing metallic material may be damaged. Known examples in which the above-described problems have been improved are described with reference to FIGS. 6 and 7.

FIG. 6 is a fragmentary plane view illustrating a hearth structure of a known rotary hearth furnace. In the hearth structure, an annular rotary hearth 52 is arranged between an inner circumference wall and an outer circumference wall, and an intermediate part of the rotary hearth 52 in an inner-outer direction is constituted of a refractory castable layer 55. On at least one of the inner circumference side or the outer circumference side of the refractory castable layer 55, a plurality of rows of refractory bricks 73 and 74 are adjacently arranged in the inner-outer direction to form predetermined gaps 57 and 58 between the rows of refractory bricks 73 and 74.

Moreover, a rotary hearth furnace according to another known example is described with reference to fragmentary schematic view 7 illustrating a cross section of the rotary hearth furnace. The rotary hearth furnace includes a hearth central body 35 which has a rotatable hearth frame 32, a heat insulating brick 33 which is arranged on the hearth frame 32, and a castable refractory 34 which is arranged on the heat insulating brick 33. The rotary hearth furnace is constituted of refractories, and includes a hearth inner-outer circumference position determination part 37 which is arranged on the hearth frame 32.

In the rotary hearth furnace, to an inner-outer circumference part of the heat insulating brick 33 of the hearth central body 35, a step part 38 is formed using the same heat insulating brick and an expansion margin 39 is provided between the heat insulating brick which forms the step part 38 and the castable refractory 34 which is arranged inside of the step part 38. The expansion margin 39 is provided in a size of 25 mm or more, preferably, 30 mm.

To the hearth inner-outer circumference position determination part 37, a castable refractory 40 is provided. To an outer circumference of the castable refractory 40, an L-shaped metallic material 41 which is fixed to the hearth frame 32 is arranged. On the castable refractory 40, a position determination refractory 42 which is formed by layering an inorganic fiber heat insulating material is provided. The position determination refractory 42 is fixed to the castable refractory 40.

However, in the conventional rotary hearth furnace described with reference to FIG. 6, there is no specific description how much the size of the gaps 57 and 58 formed as the thermal expansion margins should be.

On the other hand, in the known example described with reference to FIG. 7, the specific size of the expansion margin 39 is described. However, the size of the expansion margin 39 is the size compensated according to the calculation if the width of the castable refractory 34 is 2825 mm, it is not possible to apply the known example to a case in which a size of a furnace or a material constituting the furnace is different. Accordingly, the known example cannot be a guiding technique which shows how to determine the expansion margin. Further, in any of the above-described known examples, there is a problem that the furnace structures are too complicated and therefore, the construction is difficult and the costs increase.

In the rotary hearth furnace, at a time of heating, the temperature increases to 500° C. or more, and in some cases, increases to 600° C. or more. Then, by external force due to thermal expansion which acts on the corner refractories, force in a lateral direction acts on the corner refractory hearth curb castings which supports the corner refractories. Accordingly, it is necessary to use expensive alloy, for example, alloy corresponding to ASTM HH, for the corner refractory hearth curb castings. However, there is a problem that the alloy is short in the life.

DISCLOSURE OF INVENTION

Accordingly, an object of the present invention is, while presenting general equations capable of adequately determining a thermal expansion margin in the rotary hearth furnace, to provide a rotary hearth furnace which has a simple hearth structure in which the hearth is not damaged even if the hearth is operated for a long term.

In consideration of the above, the inventors have diligently studied about expansion/contraction process of the hearth structure of the rotary hearth furnace. As a result, the inventors found that by modifying the structure of the corner refractory, it is possible to prevent damage of the hearth, to prevent the corner refractory from falling to the outside the hearth, or being floated, and made the present invention.

Specifically, in the present invention, a rotary hearth furnace in which a rotary hearth being arranged between an outer circumference wall and an inner circumference wall includes an annular hearth frame, a hearth heat insulating material arranged on the hearth frame, a plurality of refractories arranged on the hearth heat insulating material, an outer circumference side corner refractory arranged to an outer circumference part of the rotary hearth through a hearth curb casting, and an inner circumference side corner refractory arranged to an inner circumference part of the rotary hearth through a hearth curb casting. In the rotary hearth furnace, between the corner refractory of the outer circumference side or the inner circumference side and the refractory, or between each of the refractories, a radius direction thermal expansion margin X defined by the following equation 2 is set:

$X$=([$X0$=] a distance between an outer end part of an outer circumference side hearth curb casting and an inner end part of an inner circumference side hearth curb casting at an operation temperature)−([$X1$=] a total of lengths of a plurality of refractories and both corner refractories in a radius direction at a room temperature) Equation 2 and if a width of the outer circumference side corner refractory is given as A and a height of the hearth curb casting of the corner refractory is given as B, the following equation 1 is satisfied:

$$X+A<\sqrt{(A^2+B^2)} \quad \text{Equation 1}$$

Further, in the present invention, a rotary hearth furnace in which a rotary hearth being arranged between an outer circumference wall and an inner circumference wall includes an annular hearth frame, a hearth heat insulating material arranged on the hearth frame, a plurality of refractories arranged on the hearth heat insulating material, an outer circumference side corner refractory arranged to an outer circumference part of the rotary hearth through a hearth curb casting, and an inner circumference side corner refractory arranged to an inner circumference part of the rotary hearth through a hearth curb casting. In the rotary hearth furnace, while the inner circumference side corner refractory is divided into a plurality of pieces in the circumferential direction, a circumferential direction thermal expansion margin Y is set between the divided inner circumference side corner refractories, and while the circumferential direction thermal expansion margin Y is defined by the following equation 5:

$Y$=([a total of] lengths of inner circumference side corner refractories between a hearth curb casting at a contact surface side at an operation temperature)−(a total of lengths of each of divided inner circumference side corner refractories between a hearth curb casting at a contact surface side at a room temperature) Equation 5 while an inner circumference length L1 and an outer circumference length L2 of the one divided inner circumference side corner refractory satisfy the following equation 3:

$$L_2>L_1+2y \quad \text{Equation 3}$$

wherein y=Y/n and n denotes the number of pieces of the divided inner circumference side corner refractories.

BEST MODE FOR CARRYING OUT THE INVENTION

Hereinafter, a best mode for carrying out the invention will be described in detail with reference to drawings.

Figure 1:
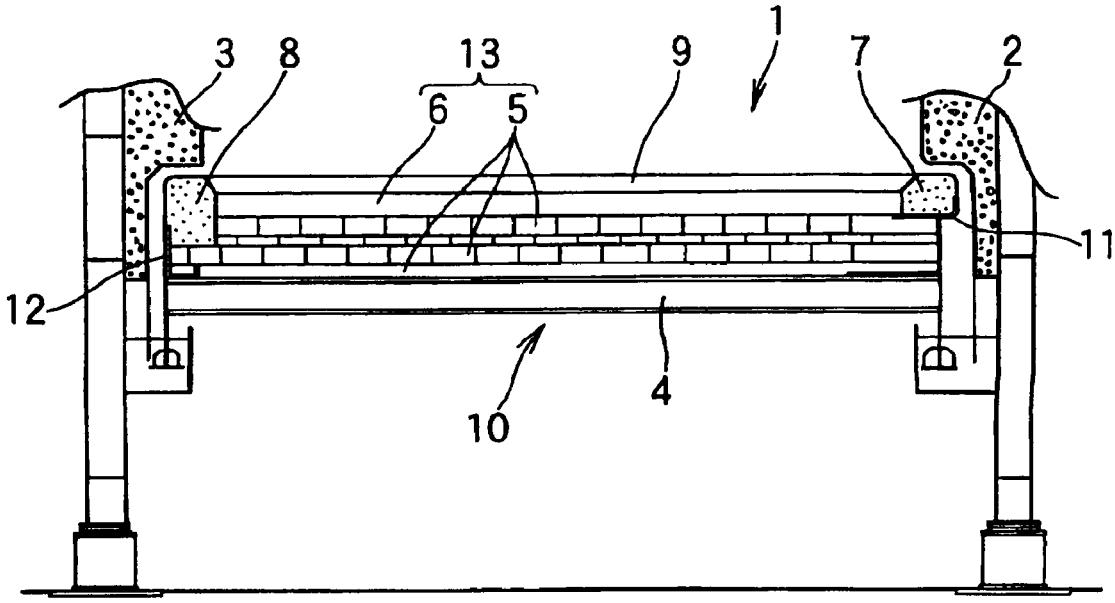
FIG. 1 is a vertical sectional view illustrating a rotary hearth furnace according to an embodiment of the present invention.

FIG. 1 illustrates an embodiment of a rotary hearth furnace according to the present invention. The drawing is a vertical sectional view of a rotary hearth furnace according to the embodiment. A rotary hearth furnace 1 includes an outer circumference wall 2, an inner circumference wall 3, and an annular rotary hearth 10 arranged between the walls. The rotary hearth 10 is rotated by a driving device (not shown).

The rotary hearth 10 includes an annular hearth frame 4, a hearth heat insulating material 5 which is arranged on the hearth frame 4, and a plurality of refractories 6 which are arranged on the hearth heat insulating material 5. The hearth heat insulating material 5 and the refractories 6 constitute a lower part heat insulation structure 13.

To an outer end part of the rotary hearth 10, an outer circumference side corner refractory 7 is arranged on the hearth heat insulating material 5 through an outer circumference side hearth curb casting 11. To an inner end part of the rotary hearth 10, an inner circumference side corner refractory 8 is arranged on the hearth heat insulating material 5 through an inner circumference side hearth curb casting 12. A large number of refractories 6 are aligned between the outer circumference side corner refractory 7 and the inner circumference side corner refractory 8 in a radius direction and circumferential direction. The outer circumference side corner refractory 7 and the inner circumference side corner refractory 8 are taller than the refractories 6 respectively and protrude upwardly higher than upper surfaces of the refractories 6. Accordingly, if operation of the rotary hearth furnace 1 is repeated, a surface material 9 such as a material to be processed which is introduced into the rotary hearth furnace 1 accumulates on the refractories 6, and the area between the outer circumference side corner refractory 7 and the inner circumference side corner refractory 8 is covered with the surface material 9.

Between the outer circumference side or the inner circumference side corner refractory 7 or 8 and the refractory 6, or between each of the refractories 6, a radius direction thermal expansion margin X is set. Specifically, to at least one or more gap between the outer circumference side corner refractory 7 and the most outer circumference side refractory 6, between each of the refractories 6 adjacent in the radius direction, and between the inner circumference side corner refractory 8 and the most inner circumference side refractory 6, a thermal expansion margin is set, and the total is set as the radius direction thermal expansion margin X. The radius direction thermal expansion margin X is defined as the following equation 2.

$X$=([$X0$=] a distance between an outer end part of an outer circumference side hearth curb casting 11 and an inner end part of an inner circumference side hearth curb casting 12 at an operation temperature)−([$X1$=] a total of lengths of a plurality of refractories 6 and the corner refractories 7 and 8 in a radius direction at a room temperature) Equation 2

Wherein "a distance between an outer end part of the outer circumference side hearth curb casting 11 and an inner end part of the inner circumference side hearth curb casting 12 at an operation temperature" denotes a distance between an outer end part of the outer circumference side hearth curb casting 11 and an inner end part of the inner circumference side hearth curb casting 12. The outer end part of the outer circumference side hearth curb casting 11 is the most outer circumference side part of the hearth curb casting 11 and the inner end part of the inner circumference side hearth curb casting 12 is the most inner circumference side part of the hearth curb casting 12. Moreover, "a total of lengths of the plurality of refractories 6 and the corner refractories 7 and 8 in a radius direction at a room temperature" denotes a total of lengths of the plurality of refractories 6 (refractory group) aligned in line in the radius direction and the outer circumference side corner refractory 7 and the inner circumference side corner refractory 8 in the radius direction.

The radius direction thermal expansion margin X is, if a width of the outer circumference side corner refractory 7 is given as A and a height of the outer circumference side hearth curb casting 11 is given as B, set to satisfy the following equation 1:

$$X+A<\sqrt{(A^2+B^2)} \quad \text{Equation 1}$$

The denotation of the equation 1 is described with reference to FIGS. 2 and 3.

Figure 2:
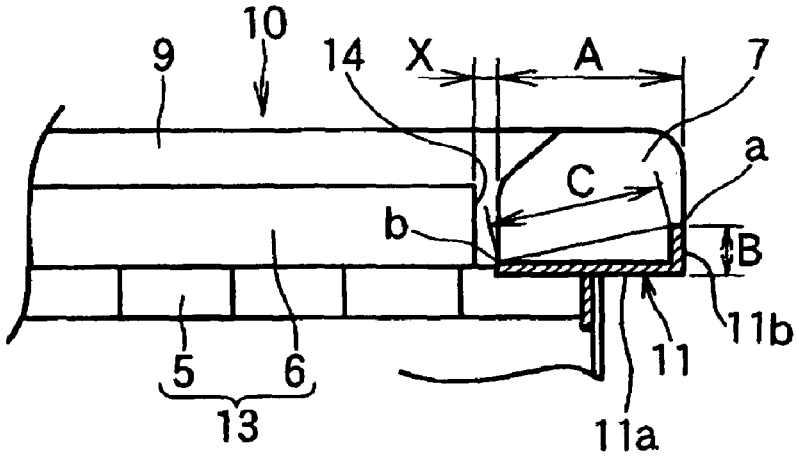
FIG. 2 is a partially enlarged cross sectional view illustrating an enlarged vicinity of an outer circumference side corner refractory illustrated in FIG. 1.
Figure 3:
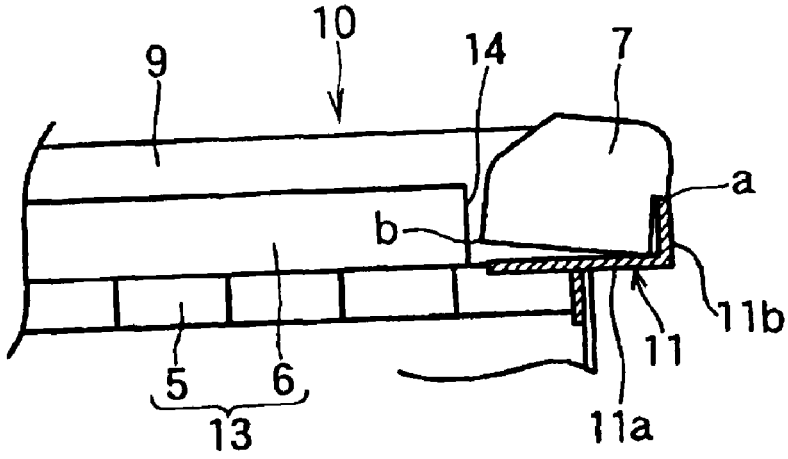
FIG. 3 is a view corresponding to FIG. 2 illustrating a state in a case in which a surface material expands.

FIG. 2 is a partially enlarged cross sectional view illustrating an enlarged vicinity of the outer circumference side corner refractory 7 illustrated in FIG. 1 and FIG. 3 is a view illustrating a state in which the surface material 9 thermally expands and pushes the outer circumference side corner refractory 7.

As illustrated in FIGS. 2 and 3, the outer circumference side corner refractory 7 is placed on the outer circumference side hearth curb casting 11 and can tilt in an outer circumference direction with an upper end part a of the outer end part of the outer circumference side hearth curb casting 11 as a fulcrum. Here, the "tilt" denotes, in the case in which the outer circumference side corner refractory 7 is pushed in the outer circumference direction by thermal expansion of the surface material 9, due to reaction of the outer circumference side hearth curb casting 11 fixed on the lower part heat insulation structure 13, the outer circumference side corner refractory 7 tilts with the upper end part a of the outer end part of the outer circumference side hearth curb casting 11 as the fulcrum.

Now, as in FIG. 2, a case in which between an outer circumference surface 14 of the most outer side refractory 6 and the outer circumference side corner refractory 7, the radius direction thermal expansion margin X is set is described. The outer circumference side hearth curb casting 11 includes a bottom part 11*a* on which the outer circumference side corner refractory 7 is placed and an outer wall part 11*b* which upwardly extends from an outer end part of the bottom part 11*a*. If the surface material 9 accumulated on the refractories 6 thermally expands, the outer end part of the surface material 9 pushes the outer circumference side corner refractory 7 to the outside. Then, the outer circumference side corner refractory 7 tilts with the upper end of the outer wall part 11*b* a as the fulcrum a.

Here, a length of a straight line which connects the fulcrum a and an inner end part b in a lower end part of the outer circumference side corner refractory 7 is defined as C. Then, with tilting movement of the outer circumference side corner refractory 7, in order to prevent outer circumference side corner refractory 7 from falling down by the inner end part b comes in contact with the outer circumference surface 14 of the refractory 6, the radius direction thermal expansion margin X and the width A of the outer circumference side corner refractory 7 are required to be in a relation to satisfy the following equation 6:

$$X+A<C \qquad \text{Equation 6}$$

On the other hand, according to the theorem of three squares, the size C can be calculated according to the following equation 7:

$$C=\sqrt{(A^2+B^2)} \qquad \text{Equation 7}$$

wherein √ ( ) denotes a square root of the equation in the parentheses.

Then, from the equations 6 and 7, the following equation 1 is given:

$$X+A<\sqrt{(A^2+B^2)} \qquad \text{Equation 1}$$

To explain simply, as illustrated in FIG. 2, the case in which the radius direction thermal expansion margin X is set between the outer circumference surface 14 of the most outer circumference side refractory 6 and the outer circumference side corner refractory 7 has been described. However, in an actual furnace structure, the radius direction thermal expansion margin X is, as defined by the equation 2, an accumulation value of gaps formed between the plurality of refractories 6.

In this case, even if the outer circumference side corner refractory 7 is pushed and tilted by the thermal expansion of the surface material 9, the inner end part b comes in contact with the outer circumference surface 14 of the refractory 6. Then, the refractory 6 is pushed to the inner circumference side and absorbed by the gaps between the refractories. Accordingly, problems such as the damage of the furnace material or falling down of the outer circumference side corner refractory 7 to the outside of the furnace will not occur.

Then, thermal expansion of the rotary hearth 10 in the circumferential direction is described. At the outer circumference side of the rotary hearth 10, effect of the thermal expansion in the circumferential direction is not large, however, at the inner circumference side, because effect of the thermal expansion in the circumferential direction is large, in the rotary hearth furnace 1 according to the embodiment, the rotary hearth furnace 1 is structured as described below.

That is, the inner circumference side corner refractory 8 is divided into a plurality of pieces in the circumferential direction. Between the divided inner circumference side corner refractories 8, a circumferential direction thermal expansion margin Y is set as defined by the following equation 5. In other words, between the divided inner circumference side corner refractories 8, a gap corresponding to the circumferential direction thermal expansion margin Y is set.

$Y$=(a total of lengths of inner circumference side corner refractories between a hearth curb casting at a contact surface side at an operation temperature)−(a total of lengths of each of divided inner circumference side corner refractories between a hearth curb casting at a contact surface side at a room temperature) Equation 5

Wherein, "a total of lengths of inner circumference side corner refractories between a hearth curb casting at a contact surface side at an operation temperature" corresponds to a length in the circumferential direction of the inner circumference side corner refractory 8 between the hearth curb casting 12 at the contact surface side. Moreover, "a total of lengths of each of divided inner circumference side corner refractories between a hearth curb casting at a contact surface side at a room temperature" corresponds to a total of lengths of each of divided inner circumference side corner refractories 8 in the circumferential direction of the inner circumference side.

Further, the circumferential direction thermal expansion margin Y is set, in a relation between one inner circumference length L1 and one outer circumference length L2 of the inner circumference side corner refractory 8 which is divided in the circumferential direction, to satisfy the following equations 3 and 4:

$$L_2>L_1+2y \qquad \text{Equation 3}$$

$$y=Y/n \qquad \text{Equation 4}$$

wherein n denotes the number of pieces of divided inner circumference side corner refractories 8.

Figure 4:
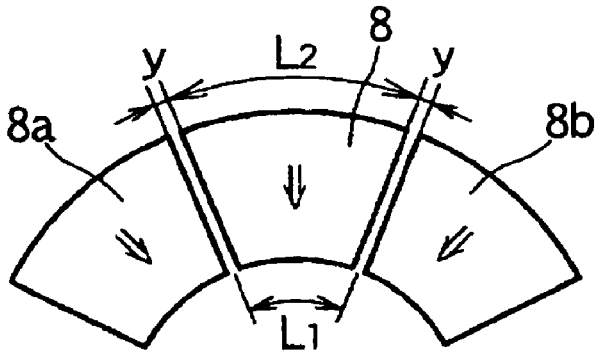
FIG. 4 is a schematic fragmentary plane view of an inner circumference side corner refractory for explaining a basis of the equation 3.
Figure 5:
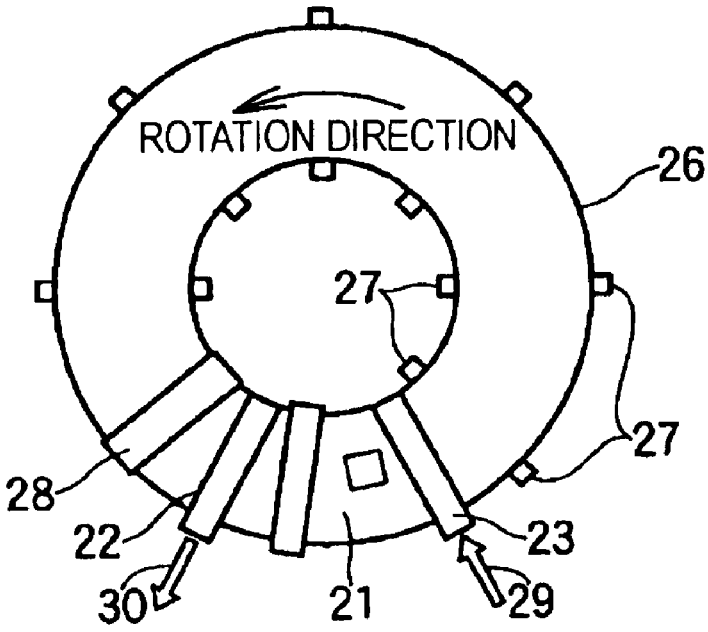
FIG. 5 is a schematic view illustrating a known rotary hearth furnace.
Figure 6:
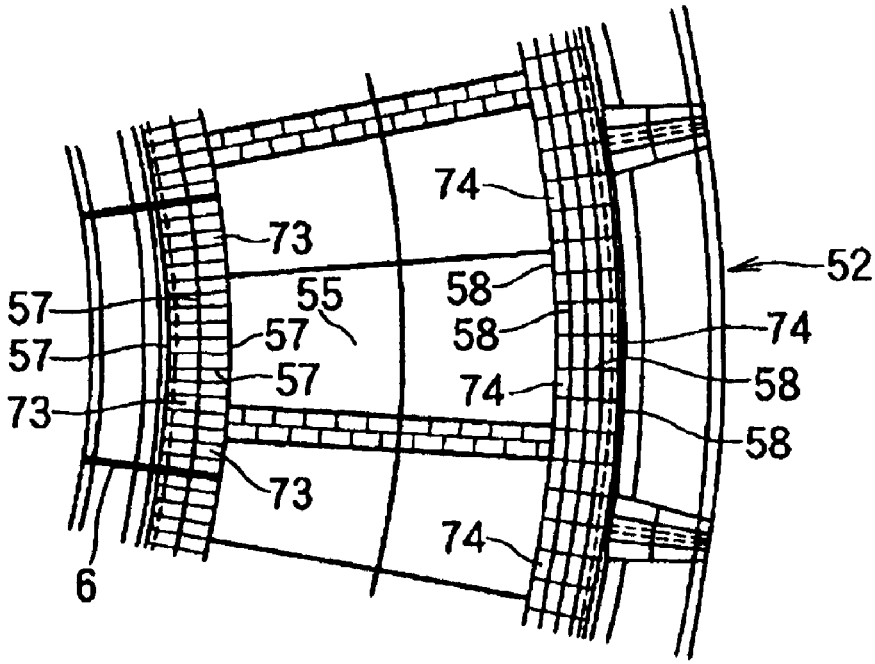
FIG. 6 is a fragmentary plane view illustrating a furnace in a known rotary hearth furnace.
Figure 7:
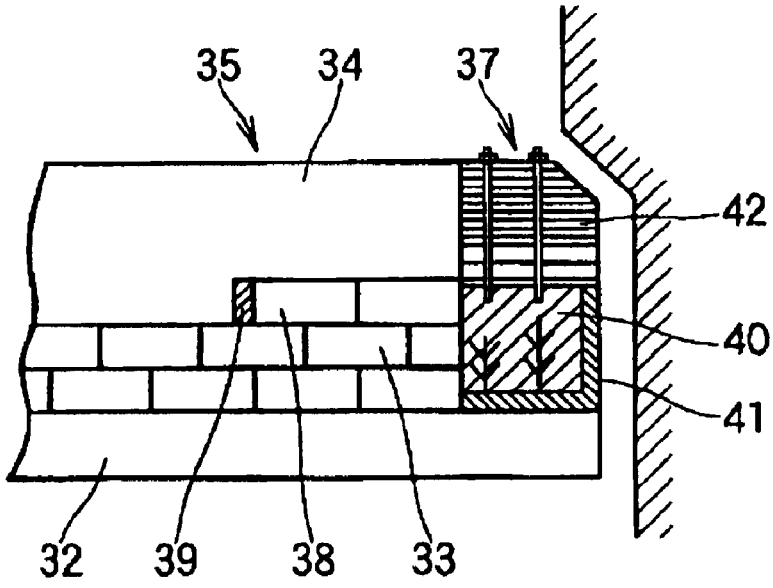
FIG. 7 is a fragmentary plane view schematically illustrating a conventional rotary hearth furnace.

FIG. 4 is a schematic fragmentary plane view of the inner circumference side corner refractory 8 for explaining a basis of the above equation 3. As clearly understood by the drawing, the equation 4 denotes the gap y between the inner circumference side corner refractories 8 adjacent to each other among the divided inner circumference side corner refractories. The inner circumference length L1 and the outer circumference length L2 of the inner circumference side corner refractory 8 are such lengths illustrated in FIG. 4.

In a case in which the surface material 9 is heated up and thermally expands, most of external force in the radius direction due to the thermal expansion acts in the outer circumference direction. However, in the vicinity of the inner circumference side corner refractory 8, on the contrary, most of external force in the radius direction due to the thermal expansion acts in the inner circumference direction. Accordingly, as illustrated in FIG. 4, also in the inner circumference side corner refractory 8, the external force in the arrow direction illustrated in the drawing acts from the outer circumference side. Because the divided inner circumference side corner refractory 8 has a fan-shape, as long as the above equation 3 is satisfied, by contacting with adjacent other the inner circumference side corner refractories 8*a* and 8*b*, the movement to the inside in the radius direction is prevented.

With respect to the above-described furnace structure of the rotary hearth furnace 1 according to the embodiment, working at a time of operation is described with reference to FIGS. 1 to 4.

When construction of the furnace structure of the rotary hearth furnace 1 is completed and operation is started, first, the surface material charged into the rotary hearth 10 is heated up. Then, the surface material 9 thermally expands in the radius direction. By the thermal expansion, the outer circumference side corner refractory 7 is pushed to the outer circumference side and tilts as illustrated in FIG. 3. However, because the inner end part b of the outer circumference side corner refractory 7 comes in contact with the outer circumference surface 14 of the most outside refractory 6, the outer circumference side corner refractory 7 is prevented from falling.

On the other hand, the inner circumference side corner refractory 8 is, during warm-up period in the initial stage of operation, pushed to the inner circumference side by the thermal expansion of the surface material 9. However, because the inner circumference side corner refractories 8 is arranged to satisfy the equation 3, in the end, the inner circumference side corner refractory 8 comes in contact with the adjacent inner circumference side corner refractories 8*a* and 8*b* and comes in a state being held. After the moment, in the surface material 9, as the temperature increases, the external force due to the thermal expansion in the radius direction acts to the outer circumference side. Accordingly, it is possible to prevent the inner circumference side corner refractory 8 from displacing to the outside of the furnace or falling down.

Then, the heat of the heated surface material 9 transmits to the refractory 6 in the lower layer by heat conduction, and if the refractory 6 is heated up, the refractory 6 also thermally expands in the radius direction. Accordingly, the lower part of the outer circumference side corner refractory 7 is pushed and the tilt of the outer circumference side corner refractory 7 returns to the original and returns to the normal state.

By the above-described furnace structure, even if the force to push the inner circumference side corner refractory 8 to the inside in the radius direction acts by the thermal expansion, as long as the circumferential direction thermal expansion margin Y between the divided inner circumference side corner refractories 8 allows, the inner circumference side corner refractories 8 are allowed to move to the inside and if the thermal expansion further proceeds, by the divided inner circumference side corner refractories 8 come in contact with each other, the movement of the inner circumference side corner refractories 8 is prevented. As a result, the external force acts on the inner circumference side hearth curb casting 12 decreases, the life of the inner circumference side hearth curb casting 12, whose life has conventionally been one or two years, is elongated, and there was no problem in a test taken after two year had passed. Further, because the inner circumference side corner refractories 8 contact with adjacent inner circumference side corner refractories 8*a* and 8*b* and comes in the state being held from a point after temperature increase, the inner circumference side hearth curb casting 12 is used only for a purpose of positioning of the inner circumference side corner refractories 8, and it is not necessary to form the inner circumference side hearth curb casting 12 by alloy which has high rigidity.

As described above, the rotary hearth furnace 1 according to the embodiment includes the annular hearth frame 4, the hearth heat insulating material 5 which is arranged on the hearth frame 4, the plurality of refractories 6 which are arranged on the hearth heat insulating material 5, and the corner refractories 7 and 8 which are arranged to the outer circumference side and the inner circumference side of the rotary hearth 10 through the hearth curb castings 11 and 12 respectively. Between the corner refractory 7 or 8 of the outer circumference side or the inner circumference side and the refractory 6, or between each of the refractories 6, the radius direction thermal expansion margin X is set. While the radius direction thermal expansion margin X is defined by the equation 2, in the relation between the width A of the outer circumference side corner refractory 7 and the height B of the outer circumference side hearth curb casting 11, the equation 1 is satisfied. Accordingly, with the simple structure, the damage of the furnace is prevented and the outer circumference side corner refractory is prevented from falling to the outside of the furnace or floating due to thermal expansion.

Further, in the rotary hearth furnace 1 according to the embodiment, while the outer circumference side corner refractory 7 is divided into the plurality of pieces in the circumferential direction, with the upper end part of the outer circumference hearth curb casting 11 as the fulcrum a, the outer circumference side corner refractory 7 can tilt in the outer circumference direction. Accordingly, even if the outer circumference side corner refractory 7 tilts to the outside due to the thermal expansion of the surface material 9, the outer circumference side corner refractory 7 comes in contact with the refractory 6 of the inside, and prevented from further tilting. Thus, it is prevented that the outer circumference side corner refractory 7 falls down or the hearth curb casting 11 which supports the outer circumference side corner refractory 7 is damaged.

Moreover, in the rotary hearth furnace 1 according to the embodiment, the inner circumference side corner refractory 8 is divided into the plurality of pieces in the circumferential direction and the circumferential direction thermal expansion margin Y is set between the divided inner circumference side corner refractories and in the relation between the inner circumference length L1 and the outer circumference length L2 of the inner circumference side corner refractory 8, the equations 3 and 4 are satisfied. Accordingly, due to the thermal expansion of the surface material 9, even if the inner circumference side corner refractory 8 receives force from the surface material 9, by inner circumference side corner refractories contact with each other, it is possible to prevent the inner circumference side corner refractories 8 and the inner circumference side hearth curb casting 12 from falling to the outside of the furnace or being damaged.

That is, in the embodiment, while the radius direction thermal expansion margin X which satisfies the equation 1 is set, in the inner circumference side of the rotary hearth 10, the circumferential direction thermal expansion margin Y which satisfies the equation 4 is set to the inner circumference side corner refractories, when the surface material 9 thermally expands, while further thermal expansion to the inner circumference side is prevented by the adjacent inner circumference corner refractories come in contact with each other, by the thermal expansion of the surface material 9 to the outer circumference side due to the thermal expansion, even if the outer circumference side corner refractory 7 tilts, by coming in contact with the refractories 6, the inner circumference side corner refractory 7 is prevented from falling down.

In the embodiment, in the rotary hearth 10, while the radius direction thermal expansion margin X is set, in the inner circumference side, the circumferential direction thermal expansion margin Y is set, however, the present invention is not limited to the structure. For example, in a case in which the surface material 9 of the outer circumference side of the rotary hearth furnace 10 is especially easily heated, etc., while the radius direction thermal expansion margin X is set, the circumferential direction thermal expansion margin Y may not be set in the inner circumference side. Alternatively, for example, in a case in which the surface material 9 of the inner circumference side is especially easily heated, etc., while the circumferential direction thermal expansion margin Y is set in the inner circumference side, the radius direction thermal expansion margin X may not be set.

Hereinafter, features of the embodiment are described below.

(1) Between the corner refractory of the outer circumference side or the inner circumference side and the refractory, or between each of the refractories, the radius direction thermal expansion margin X is set. While the radius direction thermal expansion margin X is defined by the equation 2, in the relation between the width A of the outer circumference side corner refractory and the height B of the outer circumference side hearth curb casting, the equation 1 is satisfied.

Accordingly, the damage of the furnace is prevented and the outer circumference side corner refractory is prevented from falling to the outside of the furnace or floating due to thermal expansion.

(2) While the outer circumference side corner refractory is divided into the plurality of pieces in the circumferential direction, with the upper end part in the outer end part of the hearth curb casting of the outer circumference side corner refractory as the fulcrum, the outer circumference side corner refractory can tilt in the outer circumference direction. Accordingly, even if the outer circumference side corner refractory tilts to the outside due to the thermal expansion of the surface material, the outer circumference side corner refractory comes in contact with the refractory of the inside, and prevented from further tilting. Thus, it is prevented that the outer circumference side corner refractory falls down or the hearth curb casting which supports the outer circumference side corner refractory is damaged.

(3) While the inner circumference side corner refractory is divided into the plurality of pieces in the circumferential direction and the circumferential direction thermal expansion margin Y is set between the divided inner circumference side corner refractories. While the circumferential direction thermal expansion margin Y is defined by the following equation 5, the inner circumference length L1 and the outer circumference length L2 of the one divided inner circumference side corner refractory satisfy the following equation 3:

$$L_2 > L_1 + 2y \qquad \text{Equation 3}$$

wherein y=Y/n and n denotes the number of pieces of divided inner circumference side corner refractories.

$Y$=([a total of] lengths of inner circumference side corner refractories between a hearth curb casting at a contact surface side at an operation temperature)−(a total of lengths of each of divided inner circumference side corner refractories between a hearth curb casting at a contact surface side at a room temperature) Equation 5

Accordingly, due to the thermal expansion of the surface material, even if the inner circumference side corner refractory receives force from the surface material, by inner circumference side corner refractories contact with each other, it is possible to prevent the inner circumference side corner refractories and the inner circumference side hearth curb casting from falling to the outside of the furnace or being damaged.

INDUSTRIAL APPLICABILITY

The present invention is applicable to a rotary hearth furnace in which a rotary hearth which is arranged between an outer circumference wall and an inner circumference wall includes an annular hearth frame, a hearth heat insulating material arranged on the hearth frame, a plurality of refractories arranged on the hearth heat insulating material, an outer circumference side corner refractory arranged to an outer circumference part of the rotary hearth through a hearth curb casting, and an inner circumference side corner refractory arranged to an inner circumference part of the rotary hearth through a hearth curb casting.

The invention claimed is:

1. A rotary hearth furnace in which a rotary hearth being arranged between an outer circumference wall and an inner circumference wall includes an annular hearth frame, a hearth heat insulating material arranged on the hearth frame, a plurality of refractories arranged on the hearth heat insulating material, an outer circumference side corner refractory arranged to an outer circumference part of the rotary hearth through a first hearth curb casting, and an inner circumference side corner refractory arranged to an inner circumference part of the rotary hearth through a second hearth curb casting; wherein between the corner refractory of the outer circumference side or the inner circumference side and an outermost or innermost refractory, respectively, or between each of the plurality of refractories, a radius direction thermal expansion margin X defined by the following equation 2 is set, and if a width of the outer circumference side corner refractory is given as A and a height of the first hearth curb casting of the outer circumference side corner refractory is given as B, the following equation 1 is satisfied:

$$X + A < \sqrt{(A^2 + B^2)} \qquad \text{Equation 1}$$

$X$=([$X0$=] a distance between an outer end part of the first hearth curb casting and an inner end part of the second hearth curb casting at an operation temperature)−([$X1$=] a total of lengths of the plurality of refractories and both corner refractories in a radius direction at a room temperature) Equation 2.

2. The rotary hearth furnace according to claim 1, wherein the outer circumference side corner refractory is divided into a plurality of pieces in a circumferential direction, with an upper end part in an outer end part of the hearth curb casting of the outer circumference side corner refractory as a fulcrum, the outer circumference side corner refractory is tiltable in an outer circumference direction.

3. The rotary hearth furnace according to claim 1, wherein the inner circumference side corner refractory is divided into a plurality of pieces in a circumferential direction, a circumferential direction thermal expansion margin Y is set between the divided inner circumference side corner, refractory pieces and while the circumferential direction thermal expansion margin Y is defined by the following equation 4, an inner circumference length L1 and an outer circumference length L2 of the one divided inner circumference side corner refractory satisfy the following equation 3:

$$L_2 > L_1 + 2y \qquad \text{Equation 3}$$

wherein y=Y/n and n denotes the number of pieces of the divided inner circumference side corner refractory, Y=([a total of] lengths of inner circumference side corner refractories contacting a hearth curb casting at a contact surface side at an operation temperature)−(a total of lengths of each of divided inner circumference side corner refractories contacting a hearth curb casting at a contact surface side at a room temperature) Equation 4.

4. A rotary hearth furnace in which a rotary hearth being arranged between an outer circumference wall and an inner circumference wall includes an annular hearth frame, a hearth heat insulating material arranged on the hearth frame, a plurality of refractories arranged on the hearth heat insulating material, an outer circumference side corner refractory arranged to an outer circumference part of the rotary hearth through a first hearth curb casting, and an inner circumference side corner refractory arranged to an inner circumference part of the rotary hearth through a second hearth curb casting; wherein the inner circumference side corner refractory is divided into a plurality of pieces in the circumferential direction, a circumferential direction thermal expansion margin Y is set between the divided inner circumference side corner refractory pieces, and while the circumferential direction thermal expansion margin Y is defined by the following equation 4, an inner circumference length L1 and an outer circumference length L2 of the one divided inner circumference side corner refractory satisfy the following equation 3:

$$L_2 > L_1 + 2y \qquad \text{Equation 3}$$

wherein y=Y/n and n denotes the number of pieces of the divided inner circumference side corner refractory, Y=([a total of] lengths of inner circumference side corner refractories contacting a hearth curb casting at a contact surface side at an operation temperature)−(a total of lengths of each of divided inner circumference side corner refractories contacting a hearth curb casting at a contact surface side at a room temperature) Equation 4.

* * * * *